US009399278B2

(12) United States Patent
Kuether

(10) Patent No.: US 9,399,278 B2
(45) Date of Patent: Jul. 26, 2016

(54) ELECTRIC HAND POWER-TOOL APPLIANCE HAVING MEANS OF SECURING A TOOL AGAINST LOSS

(75) Inventor: Ludwig Kuether, Waldenbuch (DE)

(73) Assignee: Metabowerke GmbH, Nuertingen (DE)

( * ) Notice: Subject to any disclaimer, the term of this patent is extended or adjusted under 35 U.S.C. 154(b) by 245 days.

(21) Appl. No.: 14/004,741

(22) PCT Filed: Mar. 22, 2012

(86) PCT No.: PCT/EP2012/055110

§ 371 (c)(1),
(2), (4) Date: Dec. 5, 2013

(87) PCT Pub. No.: WO2012/126997

PCT Pub. Date: Sep. 27, 2012

(65) Prior Publication Data

US 2014/0080387 A1 Mar. 20, 2014

(30) Foreign Application Priority Data

Mar. 23, 2011 (DE) ..... 10 2011 005 952

(51) Int. Cl.

*B24B 23/02* (2006.01)
*B24B 45/00* (2006.01)
*B24B 47/26* (2006.01)

(52) U.S. Cl.

CPC ..... *B24B 45/00* (2013.01); *B24B 23/028* (2013.01); *B24B 45/006* (2013.01); *B24B 47/26* (2013.01)

(58) Field of Classification Search

CPC .... B24B 45/006; B24B 45/00; B24B 23/022; B24B 23/02; B24B 23/028

USPC ..... 451/344, 359

See application file for complete search history.

(56) References Cited

U.S. PATENT DOCUMENTS

| | | | | |
|---|---|---|---|---|
| 5,177,905 | A | 1/1993 | Takahashi et al. | |
| 5,441,450 | A | 8/1995 | Fein et al. | |
| 5,464,365 | A | 11/1995 | Kirn | |
| 6,179,697 | B1 | 1/2001 | Shibai | |
| 6,860,792 | B2 | 3/2005 | Krondorfer et al. | |
| 7,438,634 | B2 * | 10/2008 | Habele | 451/359 |
| 2005/0271489 | A1 * | 12/2005 | Gensmann et al. | 409/231 |

FOREIGN PATENT DOCUMENTS

| | | | |
|---|---|---|---|
| DE | 42 09 146 | A1 | 9/1992 |
| DE | 43 14 799 | A1 | 11/1994 |
| DE | 195 10 291 | A1 | 9/1996 |
| DE | 199 12 001 | A1 | 9/1999 |
| DE | 199 38 299 | A1 | 3/2001 |
| DE | 199 44 564 | A1 | 3/2001 |
| DE | 19938299 | A1 | 3/2001 |
| DE | 100 59 712 | A1 | 6/2002 |
| WO | 2012/126997 | A1 | 9/2012 |

OTHER PUBLICATIONS

Office Action for German Application dated Sep. 11, 2011.
German PCT Search Report dated Jun. 15, 2012.

* cited by examiner

*Primary Examiner* — Monica Carter
*Assistant Examiner* — Lauren Beronja
(74) *Attorney, Agent, or Firm* — Randall Danskin

(57) ABSTRACT

An electric hand power-tool appliance is described and which includes a spindle, a tool mounted on the spindle, a supporting element mounted on the spindle and which is movable along the spindle on a path L, and against a force F, and in the direction of the electric hand power-tool appliance, and which increases the safety of the electric hand power-tool appliance.

1 Claim, 1 Drawing Sheet

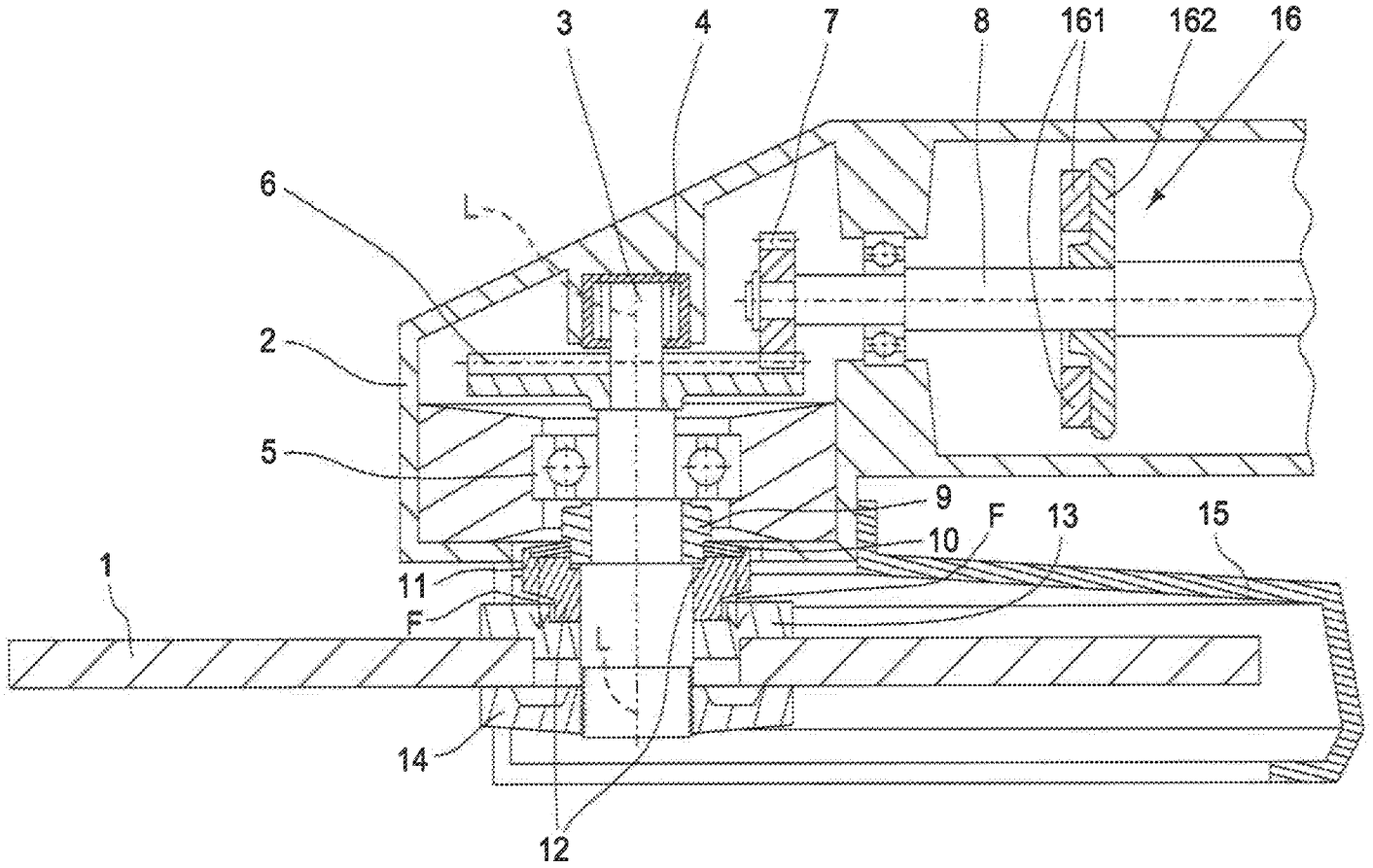
16
162
161
8
7
4
3
L
6
2
5
1
F
11
9
10
13
15
12
14

ELECTRIC HAND POWER-TOOL APPLIANCE HAVING MEANS OF SECURING A TOOL AGAINST LOSS

RELATED PATENT DATA

The present patent application claims priority to German Patent Application Serial No. 10 2011 005 952.0, and which was filed on Mar. 23, 2011; and PCT Application Serial No. PCT/EP2012/055110, and which was filed on Mar. 22, 2012.

The present invention relates to an electric hand power-tool, and in particular to an angle grinder, in which a tool is disposed on a rotatable tool spindle. In the case of such electric hand power-tools, the tool is usually fastened on the tool spindle in such a manner that during use it tightens automatically because of the torsional, forces exerted upon the tool by the workpiece, to the driving torque exerted by the machine. More recently, however, electric hand power-tools, and in particular angle grinders, have been equipped with so-called spindle brakes, which allows the user to brake the decelerating tool, for example by means of a disk brake, in order that the user can more rapidly set aside the electric hand tool and move on to another work task. The use of spindle brakes is somewhat problematic, however, in that, upon use of the spindle brake, the torque ratios between the tool and the spindle, or a fastening nut, by means of which the tool is fastened on the spindle, are reversed as compared with the usual operation of the tool. In other words, when the tool spindle is being braked, the tool itself, owing to its moment of inertia, exerts upon the fastening nut a torque that could slacken or loosen the fastening nut. This may result in the risk of the still rotating tool becoming loose or, in an extreme case, springing off of or being released from the tool spindle. This is unacceptable for safety reasons alone.

Various approaches have been pursued in the past to counter the problem which is described above. Thus, for example, the international patent application WO 93/05927 A1 presents a hand power-tool in which a tool, and in particular an abrasive disk, is located between an inner flange and an outer flange. In this arrangement, and provided on the side of the inner flange that faces away from the tool there is provided a wedge body, which has two wedge faces that slide onto each other as the tool spindle is being braked, and which thus increase the pressure between the two said flanges, as a result of which detaching of the tool from the tool spindle is effectively counteracted. A disadvantage of the described solution, however, is that practically any braking operation tends to increase the tension between the flanges. In particular, the tension between the flanges according to the described prior art also depends on the nature of the braking operation itself, i.e. the said tension between the flanges will be greater or lesser according to whether the operator brakes more strongly or less strongly. Consequently, the mode of operation described above has the result that, for the purpose of deliberately detaching the tool, and in particular for a tool change, the operator has to apply a different torque in practically every case. Moreover, in many cases, the tension between the two flanges may have increased, because of the previous braking operations, in such a way that it is no longer possible for the tool to be easily detached by the operator, and consequently the latter has to resort to aids such as, for example, a cylinder wrench, in order to be able to change the tool at all.

Proceeding from the described prior art, the object of the present invention is to create a simple and robust securing means which substantially prohibits the accidental detachment of a tool mounted on an electric hand power-tool appliance during braking, and wherein simple tool changing by an operator nevertheless remains possible.

This object of the invention is achieved by the device having the features stated in claim 1. The dependent claims relate to advantageous embodiments and variants of the present invention.

The electric hand power-tool appliance according to the present invention has a rotatable tool spindle for receiving a tool, and wherein the tool spindle has a supporting element for supporting the tool. The supporting element in this invention is designed such that the tool, after it comes into contact with the supporting element when the tool is received on the tool spindle, can be moved on a path L, against a force (F), and along the tool spindle, and axially in the direction of the electric hand power-tool appliance.

In other words, upon tightening of the tool and following the axial movement associated therewith, there is exerted upon the tool, via the supporting element, a counter-force that counters the further axial movement of the tool.

The tool can be fixed onto the tool spindle by means of, for example, a fastening nut. It is likewise conceivable for the tool itself to have a thread, which acts in combination with another thread which is provided on the tool spindle. Such tools, in particular abrasive or roughing disks, are also known by the term "hubbed wheel".

Thus, the tightening of the tool on the tool spindle results in a defined force F being generated, in the manner of an initial tension, which improves the frictional contact between the threads involved in the fixing or mounting of the tool on the tool spindle.

The described features have the effect that the tool on the tool spindle is effectively secured against becoming inadvertently detached, as can happen, in particular, in the case of the rotating tool spindle being braked by means of a spindle brake. This securing action is based substantially on the fact that, even in the case of a slight rotation of the involved thread in the direction of detachment, the initial tension described above is at least partially maintained, and consequently a sufficient frictional contact still remains present between the threads to hold or maintain the tool on the tool spindle. Without the described initial tension, even a slight rotation in the direction of detachment would greatly reduce the frictional contact between the threads, and consequently cause a furthering inadvertent or complete slackening of the involved thread and therefore precipitate an inadvertent loss of the tool.

Since the initial tension is generated by components that are located entirely on the side of the tool spindle that faces toward the electric hand power-tool appliance, the described solution can be largely non-dependent on the nature of the fastening of the tool on the tool spindle. In particular, the solution according to the present invention can also be applied to tools that themselves have a thread for fixing on a corresponding thread on the tool spindle, such that a comparatively wide field of application is obtained for the solution according to the teachings of the present invention.

Even in the case in which an operator screws the tool onto the tool spindle with only a slight tightening torque, the latest time at which the tool becomes effectively tightened is when the electric hand power-tool appliance is first switched on or energized, said tightening being due to the moment of inertia experienced by the tool as the tool spindle starts rotation, such that the desired initial tension is achieved in this situation, as well.

A further advantage of the disclosed solution according to the teachings of the present invention is that, because of the features of the invention, the tool spindle can be braked rapidly, such that, after switching it off, the operator can rapidly set aside the electric hand power-tool appliance equipped with the solution according to the invention and attend to other work tasks. In view of the way the present invention operates, the operator does not need any instruction whatsoever, since the procedure of mounting a tool on an electric hand power-tool appliance equipped with the solution according to the present invention does not differ in any respect from the procedure in the case of conventional electric hand power-tool appliances.

Likewise, the manner of detaching the tool is unchanged as compared with the prior art. In particular, detaching the tool which is secured according to the teachings of the present invention does not require increased effort and, in addition, the operator does not need to actuate a separate detaching mechanism.

Moreover, the solution according to the present invention is distinguished from other solutions in that it can be realized by means of a relatively simple, and robust construction.

Thus, in a simple embodiment of the invention, the supporting element itself can be realized as an element that is elastically deformable in the axial direction. For example, this structure may be made of a hard rubber.

Further, the supporting element can be realized as an element that can be moved in the axial direction and in opposition to the force F as earlier described.

In the present invention, the supporting element, for its part, can be supported on an axially movable intermediate element, and the intermediate element can be mounted on a spring element that, for its part, is supported on a flange, and is further fixed in the axial direction, on the tool spindle.

Both the intermediate element and the spring element in the presently described invention can be disposed in a rotationally fixed, but axially movable manner on the tool spindle. The described variant also enables the present invention to be realized with a comparatively simple construction. In this invention, a desired force characteristic expressed along the path L can be set through the choice of a spring element. The selected spring element can be a disk spring, a spring ring or another elastic or biasing element.

Since there is a stop provided to limit the axial movement of the tool in the direction of the electric hand power tool appliance, a defined initial tension can be set. Further, because of the provision of the stop, an operator, when fixing the tool on the tool spindle, obtains a tactile indication that the tool is fixed with sufficient tightness.

The force F can be selected so as to be non-dependent on the distance traveled along the total path L, and in particular so as to be constant.

Moreover, it is conceivable that, when the tool is being fixed, the force F initially increases and subsequently decreases during the axial movement in the direction of the electric hand power-tool appliance.

Such a force characteristic can be achieved, in particular, through the use of a disk spring. The described force characteristic has the effect that, during the braking of the tool, the frictional contact between the involved threads initially increases, upon a slight rotation of the thread in the direction of detachment, and then consequently the desired securing effect occurs.

Alternatively, the force F can also increase monotonically along the path L.

BRIEF DESCRIPTION OF THE DRAWINGS

An exemplary embodiment of the invention is explained in the following specification with reference to the sole FIGURE which is provided herewith.

The attached drawing is a fragmentary, transverse vertical sectional view taken through an electric hand-power tool which employs the features of the present invention.

DETAILED DESCRIPTION OF THE PREFERRED EMBODIMENTS

The attached drawing shows, in a highly schematic sectional representation, a region of an electric hand power-tool appliance, in the present case an angle grinder, that carries a tool, in this case an abrasive disk 1. To receive or otherwise support the abrasive disk 1, there is provided a tool spindle 3 which is rotatably mounted in an accompanying transmission housing 2. In the example as shown, the mounting of the tool is effected by means of a roller bearing 4 and a ball bearing 5. Likewise represented in the drawing is the ring gear 6, which is connected to the tool spindle 3 in a rotationally fixed manner and which is further in engagement with a pinion 7 that is mounted on a drive shaft 8.

On the tool spindle 3, a flange 9 is provided, and which is connected to the tool spindle 3 in a rotationally fixed manner and which further, in the example shown, is screwed onto the tool spindle 3, and which further adjoins the ball bearing 5.

Mounted on the side of the flange 9 that faces toward the abrasive disk 1 there is provided a disk spring 10, which acts as a spring element, and on which there is disposed a supporting element, or double-flat 11, as an intermediate element. The supporting element or double-flat 11 in this case is movable, in opposition to the spring 25 force of the disk spring 10, and in the axial direction, i.e. in particular also in the direction of the electric hand power-tool appliance. The supporting element or double-flat 11 is further elastically deformable in the axial direction. The axial movement of the double-flat 11 is delimited on the appliance side by the stop 12. The double-flat 11 additionally 30 carries another supporting element, which is disposed on the tool spindle 3 in the direction of the abrasive disk and which, in the present example, this other supporting element is realized as a supporting flange 13. In the example shown, the abrasive disk 1 is fixed on the tool spindle 3 by means of the fastening nut 14.

Further, the abrasive disk 1 is at least partially surrounded by the protective hood 15.

After the appliance has been switched off or deenergized by an operator, the abrasive disk 1 can be brought rapidly to a standstill by means of a spindle brake 16, having a brake disk 162, which is disposed on the drive shaft 8, and brake pads 161 that selectively act upon this brake disk.

As the fastening nut 14 is being tightened by an operator, a force acts upon the abrasive disk 1 in the axial direction, and in particular in the direction of the electric hand power-tool appliance. This force is transmitted to the axially movable supporting flange 13 and the double-flat 11. The entire arrangement, consisting of the fastening nut 14, abrasive disk 1, supporting flange 13, and the supporting element or double-flat 11 is therefore moved, in opposition to the force F which is exerted by the disk spring 10, as far as the stop 12. An initial tension upon the fastening nut 14 is thereby generated as the abrasive disk 1 is being appropriately mounted. In this case, the disk spring 10 can have, in particular, a characteristic in which the force F initially increases and subsequently decreases. It can thereby be achieved that the frictional contact between the fastening nut 14 and the tool spindle 3 initially increases, upon a first slackening of the fastening nut 14, for example in the case of a braking operation, such that further slackening of the fastening nut 14 is counteracted.

The presence of the stop 12 ensures that the operator, when fixing the abrasive disk 1 on the tool spindle 3, obtains a defined tactile indication of the point at which the abrasive disk 1 is sufficiently fixed on the tool spindle 3. Even in those cases in which the operator fails to tighten the fastening nut 14 until it reaches the stop 12, the electric hand power-tool appliance, when first switched on or energized, will automatically tighten the fastening nut 14 until it reaches the stop 12, because of the moment of inertia of experienced by the abrasive disk 1, and will thereby fix or otherwise effectively secure the abrasive disk 1 on the tool spindle 3 in a practically and appropriate captive manner.

In an embodiment of the invention that is not represented in the drawing, the tool 1 itself has a thread for screw-fastening on the tool spindle 3. In this case, there is no need for use of either the fastening nut 14 or the supporting flange 13. The tool can then be put against, for example, the intermediate element 11, as a supporting element in the meaning of the present invention, or against an element corresponding to the intermediate element 11; alternatively, the supporting element can be realized in another manner.

What I claim is:

1. An electric hand power-tool appliance, comprising:

an elongated, and rotatable tool spindle which is mounted on the electric hand power-tool appliance, and wherein the rotatable tool spindle has a longitudinal axis, and a proximal end which is mounted in force receiving relation relative to the electric hand-power tool appliance, and an exterior-threaded, distal end which cooperatively receives a tool which is rotated by the tool spindle when the electric hand power-tool is energized, and wherein the exterior-threaded distal end of the rotatable tool spindle extends through the tool, and the tool is coaxially rotatable relative to the rotatable tool spindle;

a flange which is immovably mounted on the rotatable tool spindle, and which is further located at a predetermined position which is between the proximal and distal ends thereof, and wherein the flange is coaxially oriented relative to the rotatable tool spindle, and is further co-rotatable therewith;

a spring member received in a coaxial orientation about the rotatable tool spindle, and which rests, at least in part, against the flange, and which further extends in the direction of the tool, and wherein the spring member, when compressed, exerts a coaxially oriented biasing force in the direction of the tool;

an elastically deformable support element which is moveably received and positioned in a coaxial orientation about the rotatable tool spindle, and wherein the spring member biasingly engages the elastically deformable support element, and wherein the spring member is further located between the elastically deformable support element, and the flange, and wherein the elastically deformable support element is longitudinally moveable along a coaxial path of travel relative to the rotatable tool spindle;

a supporting flange which has opposite sides, and which further is coaxially received about, and is coaxially moveable relative to the exterior-threaded, distal end of the rotatable tool spindle, and wherein the elastically deformable support element is disposed in a coaxial, resilient, force transmitting relationship relative to one of the sides of the supporting flange, and wherein the opposite side of the supporting flange forcibly engages the tool which is received on the exterior-threaded, distal end of the rotatable tool spindle; and a fastening nut which threadably mates with the exterior-threaded distal end of the rotatable tool spindle, and wherein the fastening nut, when threadably advanced in the direction of the electric hand power-tool appliance, threadably tightens the tool on the rotatable tool spindle, and wherein the threadable advancement of the fastening nut in the direction of the electric hand-tool appliance exerts a coaxial force which simultaneously moves the tool, supporting flange, and the elastically deformable support element in a coaxial, longitudinal direction along the rotatable tool spindle, and towards the electric hand power-tool appliance, and further, simultaneous places both the spring member, and the elastically deformable support element into a state of compression so as to create a coaxial biasing force which is directed coaxially along, and in a direction towards the exterior-threaded, distal end of the rotatable tool spindle, and wherein the coaxial biasing force exerted by the compression of both the elastically deformable support element, and the spring element, increases, and then decreases as the fastening nut is threadably advanced towards the electric hand power-tool appliance, and wherein, upon a braking of the rotation of the rotatable tool spindle, and which precipitates a threadable loosening of the fastening nut, the coaxial biasing force exerted by the spring element, and the elastically deformable support element resiliently resists a further threadable loosening of the fastening nut.

* * * * *